US008757320B2

(12) United States Patent
Liao

(10) Patent No.: US 8,757,320 B2
(45) Date of Patent: Jun. 24, 2014

(54) SUSPENDING AND MOVING DEVICE

(76) Inventor: Fu-Chang Liao, Miaoli Hsien (TW)

( * ) Notice: Subject to any disclaimer, the term of this patent is extended or adjusted under 35 U.S.C. 154(b) by 222 days.

(21) Appl. No.: 13/311,393

(22) Filed: Dec. 5, 2011

(65) Prior Publication Data

US 2013/0081902 A1 Apr. 4, 2013

(30) Foreign Application Priority Data

Sep. 29, 2011 (TW) ..... 10135442 A
Oct. 29, 2011 (TW) ..... 10139535 A

(51) Int. Cl.
*B66F 11/04* (2006.01)

(52) U.S. Cl.
USPC ..... 182/37

(58) Field of Classification Search
USPC ..... 182/36–39, 12; 187/239
See application file for complete search history.

(56) References Cited

U.S. PATENT DOCUMENTS

| | | | | |
|---|---|---|---|---|
| 356,650 | A * | 1/1887 | Landgraf | 182/37 |
| 536,232 | A * | 3/1895 | Potts | 182/15 |
| 641,121 | A * | 1/1900 | Knight | 182/13 |
| 759,335 | A * | 5/1904 | Wheeland | 182/12 |
| 863,222 | A * | 8/1907 | Roach | 182/37 |
| 1,094,213 | A * | 4/1914 | Jones | 182/12 |
| 1,153,200 | A * | 9/1915 | Daniels | 187/379 |
| 3,394,776 | A * | 7/1968 | Abrams | 182/36 |
| 4,979,589 | A * | 12/1990 | Sugiyama et al. | 182/38 |
| 5,715,557 | A * | 2/1998 | Hsu | 15/50.3 |
| 6,302,238 | B1 * | 10/2001 | Preusser et al. | 182/150 |
| 2007/0205049 | A1 * | 9/2007 | Yang et al. | 182/128 |
| 2009/0282747 | A1 * | 11/2009 | Epp et al. | 52/20 |

FOREIGN PATENT DOCUMENTS

| | | |
|---|---|---|
| DE | 29609481 | 11/1996 |
| DE | 19648929 | 6/1998 |
| DE | 102007039290 | 3/2008 |
| EP | 0709054 | 5/1996 |
| FR | 2643626 | 8/1990 |
| JP | H 09 302916 | 11/1997 |
| JP | 2001 000367 | 1/2001 |
| JP | 2005 099234 | 1/2005 |
| WO | WO2012000133 | 1/2012 |

OTHER PUBLICATIONS

English language Abstract of WO2012000133.
English language Abstract of DE19648929.
English language Abstract of DE102007039290.
English language Abstract of FR2643626.
English language Abstract of EP0709054.

(Continued)

*Primary Examiner* — Katherine Mitchell
*Assistant Examiner* — Kristine Florio
(74) *Attorney, Agent, or Firm* — Abe Hershkovitz; Hershkovitz & Associates, PLLC

(57) ABSTRACT

A suspending and moving device has a longitudinal rail, a sliding bracket, at least one vertical rail bracket, a vertical rail positioning device and a movable basket. The longitudinal rail is mounted on a wallboard. The sliding bracket is mounted slidably on the longitudinal rail. The vertical rail is suspended downward from the sliding bracket. The vertical rail positioning device keeps the vertical rail at a distance from the wallboard. The movable basket is mounted slidably on the vertical rail, whereby the movable basket is capable of moving vertically or transversely so that maintenance workers are carried by the movable basket to move or a brush mechanism is mounted on the movable basket to clean the wallboard.

11 Claims, 11 Drawing Sheets

(56) References Cited

OTHER PUBLICATIONS

European Patent Office Search Report for GB120901.3.
English language Translation of JP2001-000367.
English language Translation of JP2005-099234.
English language Translation of JPH09-302916.

* cited by examiner

SUSPENDING AND MOVING DEVICE

BACKGROUND OF THE INVENTION

1. Field of the Invention

The present invention relates to a moving device, and more particularly to a suspending and moving device that may be located outside wallboards of an outer wall of a building and capable of moving vertically and/or transversely. The suspending and moving device may be adapted to construct carriages or mounted with brush device for cleaning the wallboards of the outer wall.

2. Description of Related Art

Conventional scaffolds or baskets suspended by cranes are generally used as constructing carriages during the maintenance of wallboards of outer walls of buildings. Furthermore, a conventional method for cleaning the wallboards or glass windows employs the basket to carry human cleaners such that the cleaners scrub manually. However, manually cleaning the wallboards is difficult and cleaners are under highly dangerous situations and suffer high risk of losing lives during the cleaning operation. No automatic cleaning operation for wallboards or glass windows is applied nowadays.

To overcome the shortcomings, the present invention provides a suspending and moving device to mitigate or obviate the aforementioned problems.

SUMMARY OF THE INVENTION

The main objective of the invention is to provide a suspending and moving device that saves scaffolds or human cleaners for manually cleaning operation applied to outer walls of buildings.

A suspending and moving device in accordance with the present invention comprises a longitudinal rail, a sliding bracket, at least one vertical rail bracket, a vertical rail positioning device and a movable basket. The longitudinal rail is mounted on a wallboard. The sliding bracket is mounted slidably on the longitudinal rail. The vertical rail is suspended downward from the sliding bracket. The vertical rail positioning device is to keep the vertical rail at a distance from the wallboard. The movable basket is mounted slidably on the vertical rail, whereby the movable basket is capable of moving vertically or transversely so that maintenance workers are carried by the movable basket to move or a brush mechanism is mounted on the movable basket to clean the wallboard.

Other objectives, advantages and novel features of the invention will become more apparent from the following detailed description when taken in conjunction with the accompanying drawings.

DETAILED DESCRIPTION OF THE PREFERRED EMBODIMENT

A moving and suspending device in accordance with the present invention has two embodiments.

Figure 1:
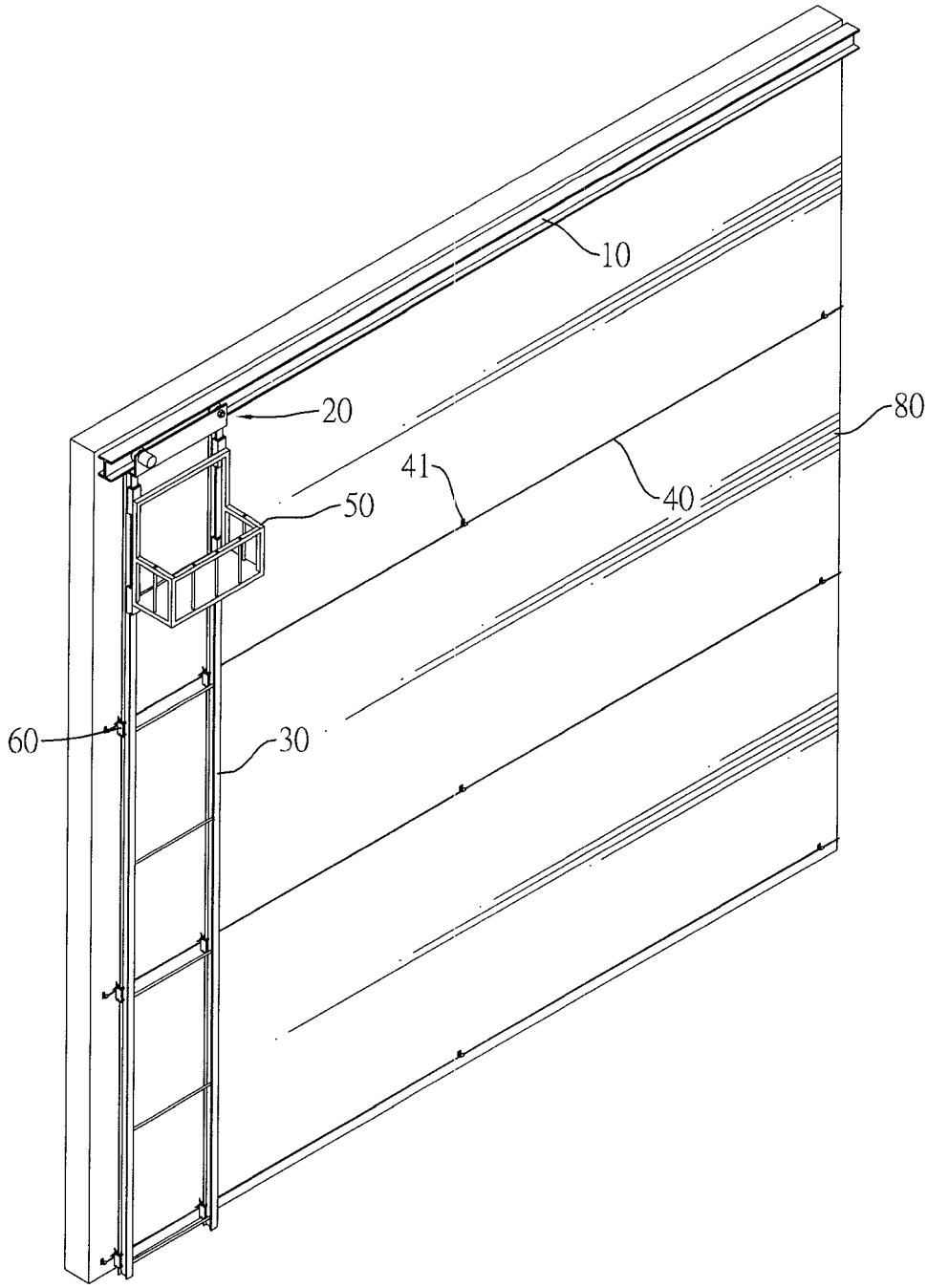
FIG. 1 is a perspective view of a first embodiment of a suspending and moving device in accordance with the present invention used on wallboards of an outer wall of a building.
Figure 2:
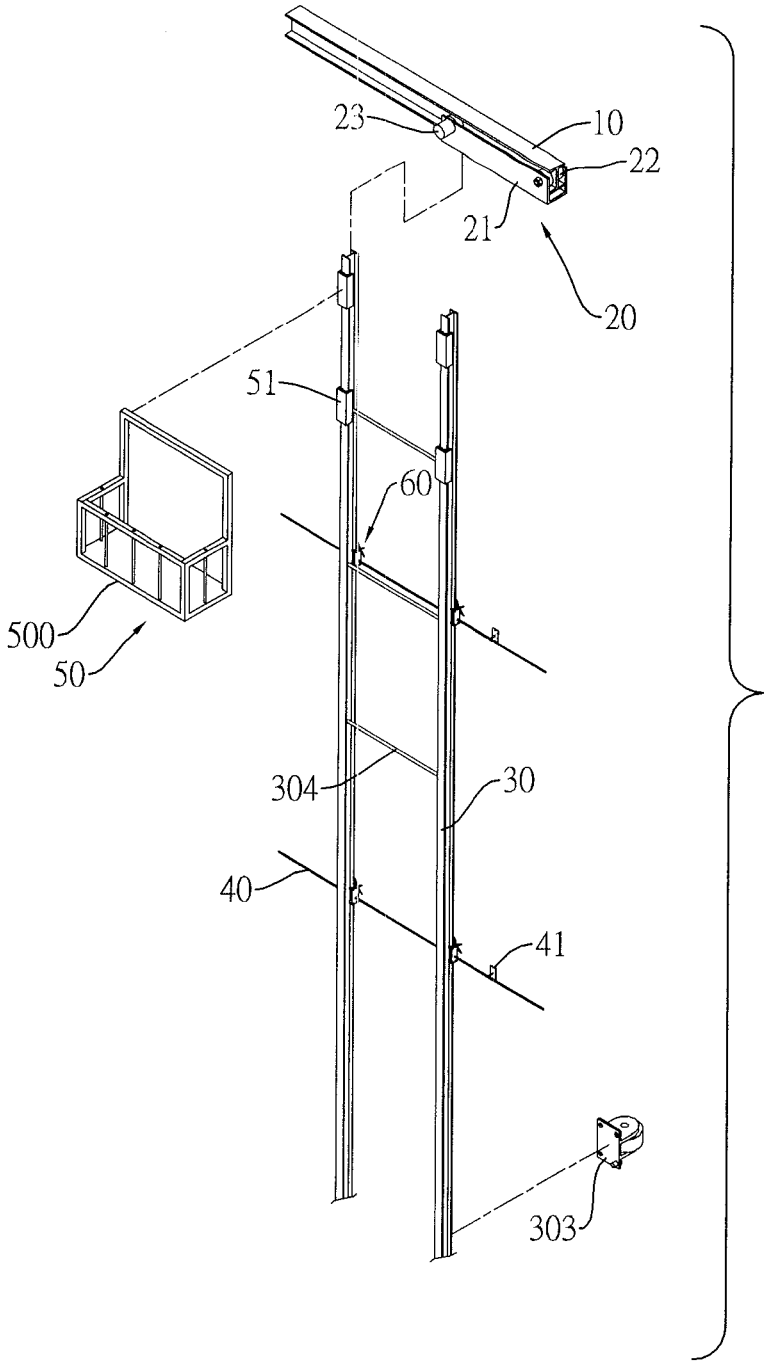
FIG. 2 is an exploded perspective view of the suspending and moving device in FIG. 1.
Figure 3:
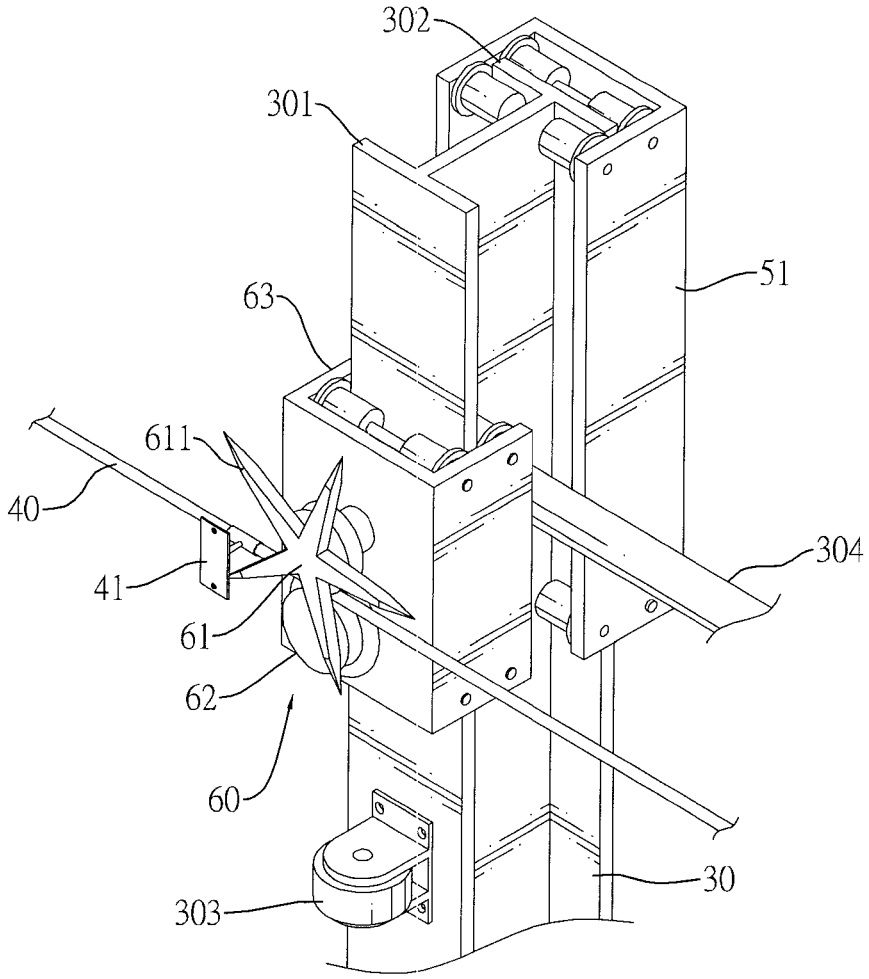
FIG. 3 is an enlarged perspective view of a leaf-shaped stopping assembly of the suspending and moving device in FIG. 1.

With reference to FIGS. 1, 2 and 3, a first embodiment of the moving and suspending device may be suspended outside a wallboard 80 of an outer wall and comprises a longitudinal rail 10, at least one sliding bracket 20, at least one vertical rail 30, a vertical rail positioning device and at least one movable basket 50.

The longitudinal rail 10 is a longitudinal configuration formed from H-shaped steel or extruded structure and is mounted horizontally on an upper side of the wallboard of the outer wall.

The sliding bracket 20 corresponds to and is mounted slidably on the longitudinal rail 10. The sliding bracket 20 has an U-shaped body 21, multiple rollers 22 and a motor 23. The U-shaped body 21 has an opening facing upward and below the sliding bracket 20. The rollers 22 are mounted rotatably in the opening and rotatably engage the longitudinal rail 10. The motor 23 is mounted on the sliding bracket 20 and drives the rollers 22 to rotate.

The vertical rail 30 is formed from H-shaped steel or extruded structure, is suspended downward from a lower side of the U-shaped body 21 of the sliding bracket 20 and has an inside plate 301, an outside plate 302 and multiple rollers 303. The inside plate 301 is located near the wallboard 80 and the outside plate 302 is located away from the wallboard 80. The rollers 303 are mounted on the vertical rail 30 adjacent to the wallboard 80. An outer edge of each roller 303 protrudes radially outward to contact and roll on the wallboard 80.

The vertical rail positioning device has multiple transverse shafts 40 and multiple leaf-shaped stopping assemblies 60.

Figure 8:
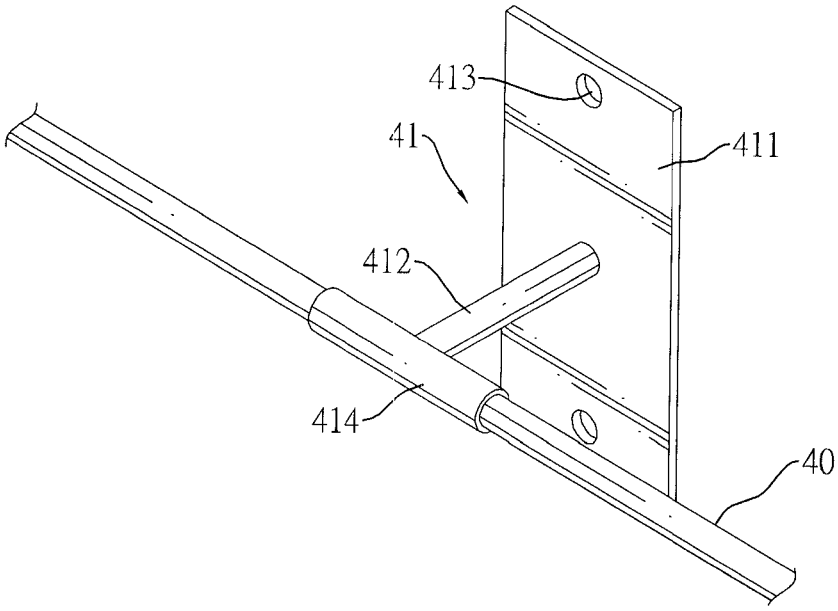
FIG. 8 is an enlarged perspective view of a vertical rail positioning device of the moving and suspending device in FIG. 1.

The transverse shafts 40 may be steel ropes, longitudinal steel bars or tubes, are mounted between the vertical rail 30 and the wallboards and parallel the longitudinal rail 10. Each transverse shaft 40 has two ends pulled tightly and mounted securely on two sides of the wallboard 80. Each transverse shaft 40 has multiple supports 41 mounted on the wallboard and spaced at intervals, as shown in FIG. 8. Each support 41 has a mounting plate 411 and a supporting bar 412 and a sleeve 414. The mounting plate 411 has multiple fastening holes 413 defined therethrough. The supporting bar 412 is mounted on and extends from the mounting plate 411. The sleeve 414 is mounted on the supporting bar 412 and has a sleeve hole mounted around the transverse shaft 40.

Figure 4:
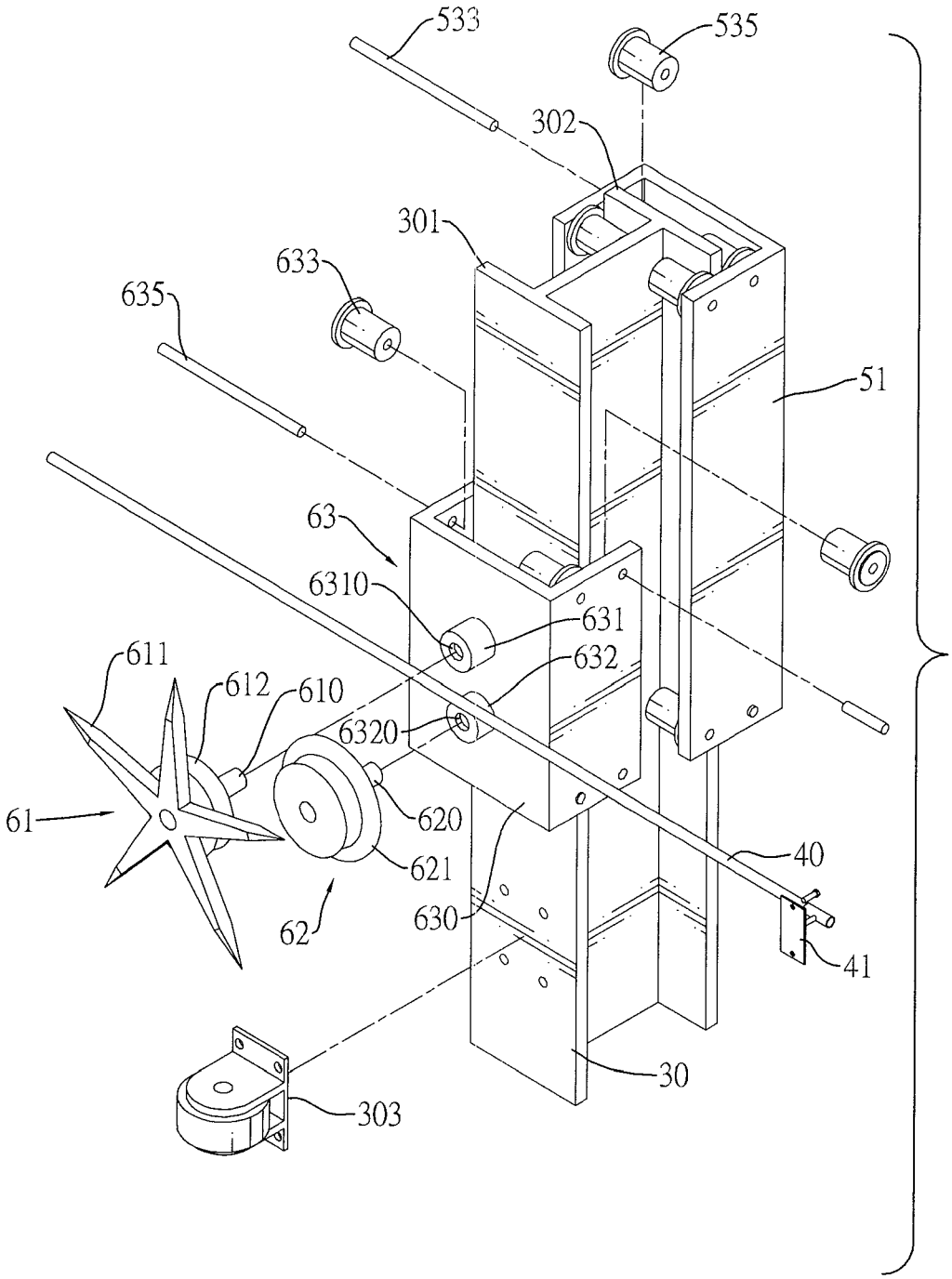
FIG. 4 is an enlarged and exploded perspective view of the leaf-shaped stopping assembly of the suspending and moving device in FIG. 3.
Figure 11:
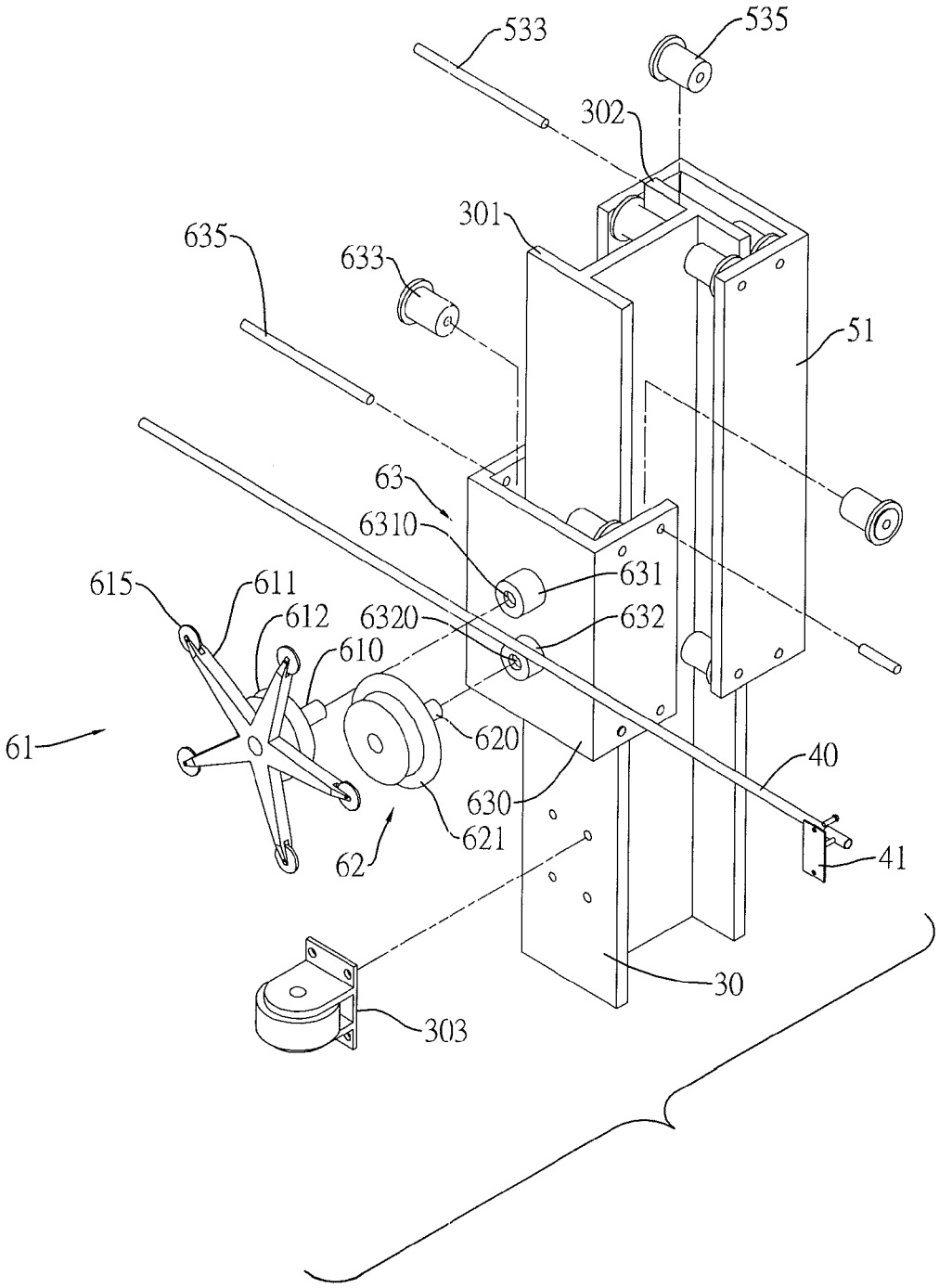
FIG. 11 is an enlarged perspective view of assistant wheels mounted on the distal ends of a leaf-shaped stopper of the leaf-shaped stopping assembly of the suspending and moving device in FIG. 1.

With reference to FIGS. 3 and 4, each leaf-shaped stopping assembly 60 is mounted on the vertical rail 30 and has a sliding member 63, an upper mount 631, a lower mount 632, a leaf-shaped stopper 61 and a wheel 62. The sliding member 63 is a U-shaped body corresponding to the vertical rail 30, is mounted slidably on the vertical rail 30 and has multiple rollers 633 mounted rotatably on the sliding member 63 by a central shaft 635 and rotatably engaging the inside plate 301 of the vertical rail 30 that is near the wallboard 80. Each roller 633 has a flange. The upper mount 631 and lower mount 632 are mounted on the sliding member 63 and arranged in a vertical line. Each of the upper mount 631 and lower mount 632 is located between the transverse shaft 40 and wallboard 80 and has a mounting hole 6310, 6320 defined therethrough. The leaf-shaped stopper 61 is annular and has a wheel member 612, a thorn element 611 and an axle 610. The thorn element 611 is formed on the wheel member 612 and has multiple radial thorns formed on the thorn element 611 and arranged circularly and having a distal end with a tip. The axle 610 is mounted rotatably in the wheel member 612 opposite to the thorn element 611 and mounted in the mounting hole 6310 of the upper mount 631. The wheel 62 has a limiting flange 621 formed on and protruding radially from the wheel 62. The leaf-shaped stopper 61 and the wheel 62 are mounted rotatably respectively on an upper side and a lower side of the transverse shaft 40. The wheel 62 also has an axle 620 and a flange. The axle 620 is mounted rotatably in the wheel 62 and mounted in the mounting hole 6320 of the lower mount 632. With reference to FIG. 11, an assistant wheel 615 may be mounted rotatably on a distal end of each thorn element 611.

Figure 6:
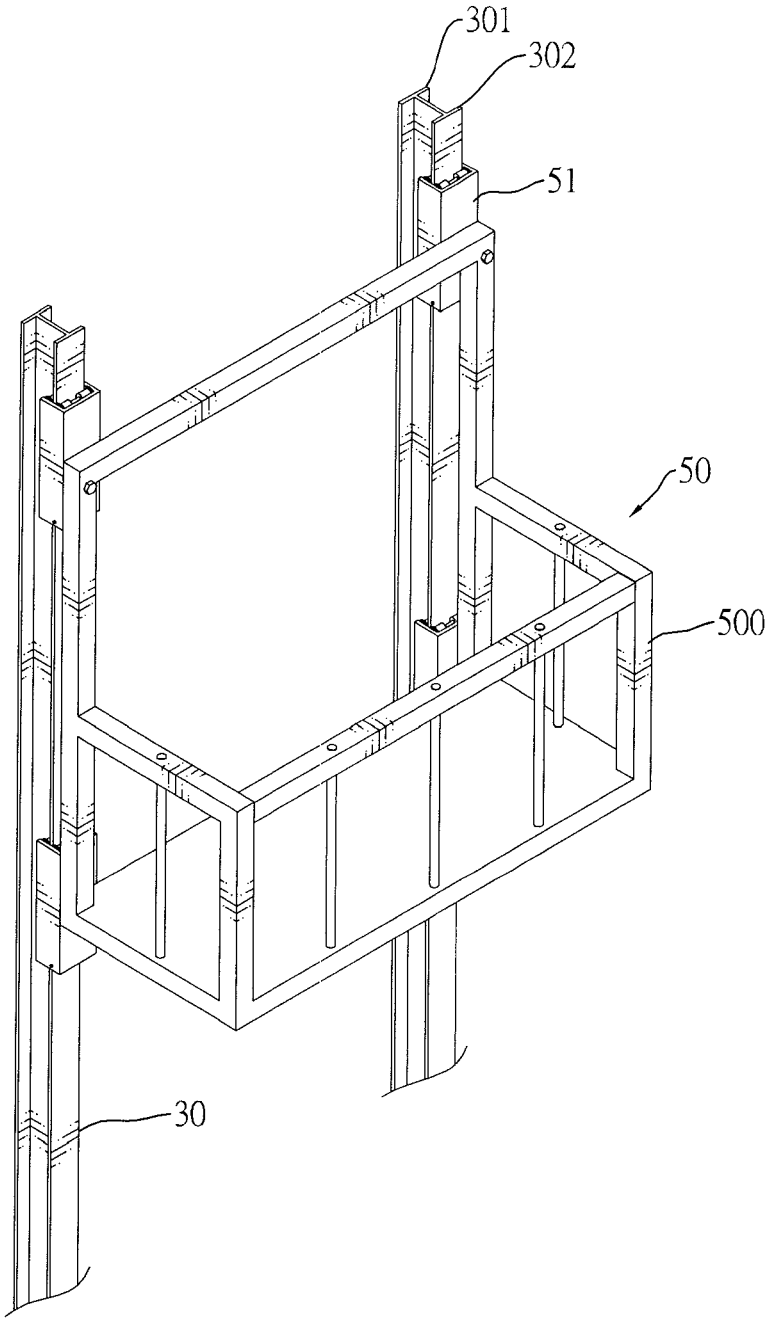
FIG. 6 is an enlarged perspective view of a movable basket of the suspending and moving device in FIG. 5.

With reference to FIGS. 1, 2 and 6, the movable basket 50 may be a human carriage and has a frame 500 formed from tubes and may function as a carrier. The movable basket 50 has multiple slides 51 mounted on a side of the movable basket 50 and mounted slidably on the vertical rail 30. A first function of the movable basket 50 is carrying people. The movable basket 50 may carry maintenance workers to maintain the wallboard 80 and is formed into a L-shaped structure with railings by tubes. With reference to FIG. 4, each slide 51 is a U-shaped body and has multiple rollers 535 mounted rotatably on the slide 51 by a central shaft 533 and rotatably engaging the outside plate 302 of the vertical rail 30. Each roller 535 has a flange. A second function of the movable basket 50 is cleaning the wallboard 80. The movable basket 50 has a brush mechanism 53 mounted on the movable basket 50 and having a motor 531. The brush mechanism 53 is conventional and therefore not described in detail.

Figure 7:
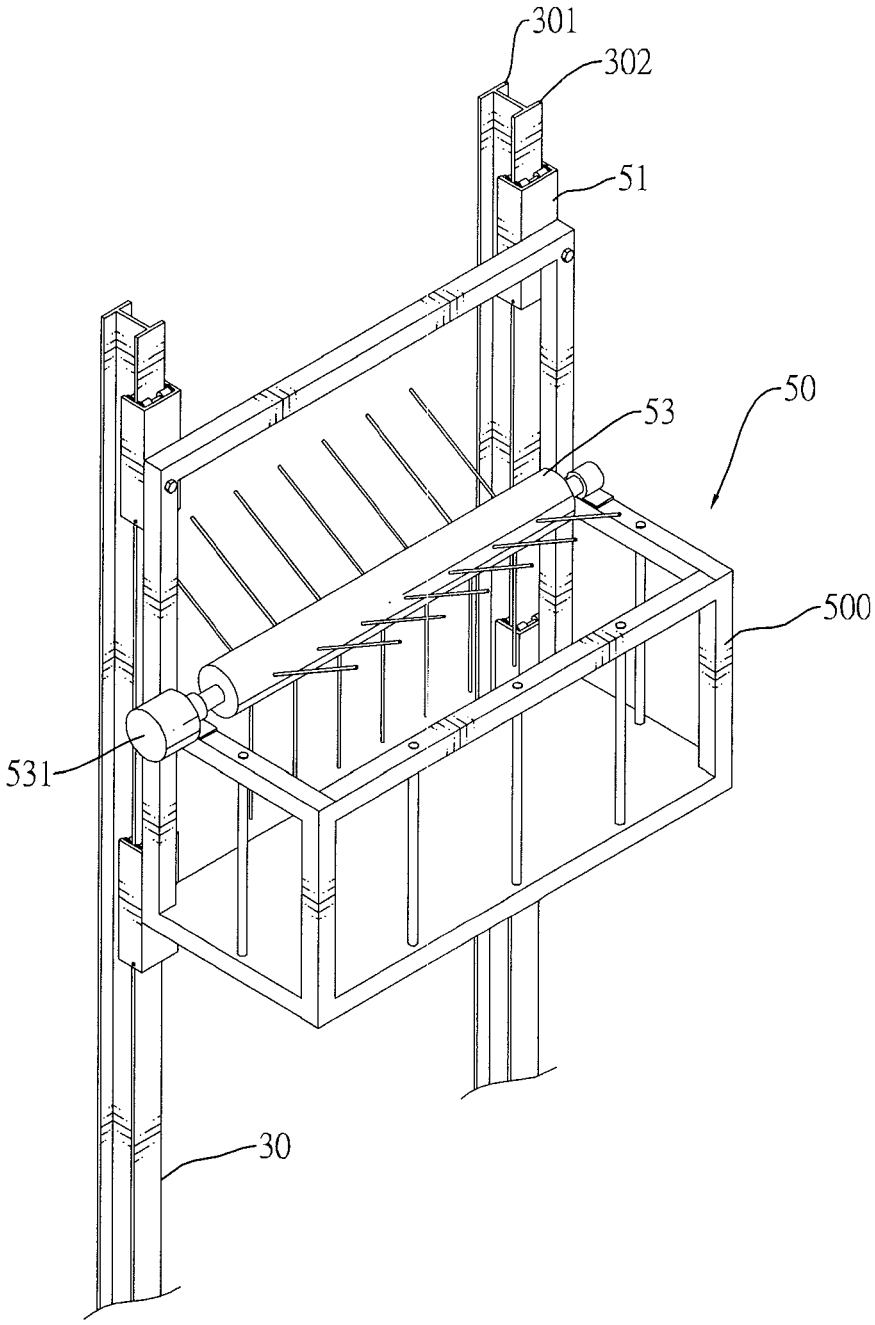
FIG. 7 is an enlarged perspective view of a brush device on the movable basket of the suspending and moving device in FIG. 6.

With reference to FIGS. 1 to 4, an assembling method of the first embodiment of the moving and suspending device is as follows. A longitudinal rail 10 is mounted horizontally on an upper side of a wallboard 80 of an outer wall. A sliding bracket 20 is mounted on the longitudinal rail 10 and is movable by a motor 23. At least one vertical rail 30 is suspended downward from the sliding bracket 20. As shown in the aforementioned figurers, two vertical rails 30 are suspended under the sliding bracket 20 and multiple crossbars 304 are mounted between the vertical rails 30 to connect the vertical rails 30 together. Multiple transverse shafts 40 are pulled tightly and mounted between two sides of the wallboard 80. Multiple supports 41 are mounted on the intermediate section of each transverse shaft 40 and mounted on the wallboard 80. A leaf-shaped stopping assembly 60 is mounted on an intersection of each vertical rail 30 and each transverse shaft 40 so that a leaf-shaped stopper 61 of each transverse shaft 40 is located between the wallboard 80 and each transverse shaft 40. A limiting flange 621 of a wheel 62 is located between each transverse shaft 40 and each vertical rail 30. The leaf-shaped stopper 61 and wheel 62 are located respectively on an upper side and a lower side of a corresponding transverse shaft 40 so that the vertical rail 30 keeps a distance from the wallboard 80 when moving transversely (horizontally). With reference to FIG. 6, multiple slides 51 are mounted slidably on the outside plate 302 of the vertical rail 30. As shown in FIG. 6, two slides 51 are arranged vertically and disposed on the outside plate 302 of each of the two vertical rails 30. A movable basket 50 is mounted on the four slides 51 so as to move along the two vertical rails 30. A rolling device mounted on the sliding bracket 20 drives the movable basket 50 to move vertically by steel ropes. With reference to FIG. 7, the suspending and moving device may have a brushing device with a motor mounted on the movable basket 50. For example, a brush mechanism 53 is mounted on the movable basket 50 so as to brush and clean the wallboard 80. The brush mechanism 53 is conventional and therefore not described in detail.

With reference to FIGS. 1, 2 and 3, a manner of using the first embodiment of the present invention is described as follows.

When the suspending and moving device of the present invention is used to carry maintenance workers to maintain the wallboard 80, the motor 23 on the sliding bracket 20 is turned on to drive the sliding bracket 20, vertical rails 30 and movable basket 50 to move transversely on the longitudinal rail 10. When the rotatable leaf-shaped stopper 61 encounters the support 41 during the movement of the sliding bracket 20 and the vertical rails 30 on the longitudinal rail 10, the thorn elements 611 of the leaf-shaped stopper 61 engage and make the leaf-shaped stopper 61 roll over the support 41 and the assistant wheel 615 on the distal end of each thorn element 11 rotates to assist the leaf-shaped stopper 61 in rolling over the support 41. Furthermore, the thorn elements 611 of the leaf-shaped stopper 61 are located between the wallboard 80 and the transverse shaft 40 during the movement of the vertical rails 30 so as to stably space the vertical rails 30 apart from the wallboard 80. The rolling device may be turned on to drive the movable bracket 50 to move vertically and transport the maintenance workers to any place on the wallboard 80 as required. With reference to FIG. 7, when the suspending and moving device of the present invention is used to clean the wallboard 80, the motor 531 of the brush mechanism 53 on the movable basket 50 is electrically controlled to drive a brush to contact the wallboard 80. The movable basket 50 is moved vertically or transversely by the aforementioned moving method. The brush mechanism 53 is conventional and therefore not described in detail.

With reference to FIGS. 2, 5, 9 and 10, a second embodiment of the suspending and moving device of the present invention is different from the first embodiment in that the vertical rail positioning device of the first embodiment has the transverse shafts 40 pulled, tightened and paralleling the longitudinal rail 10 and disposing the leaf-shaped stopping assemblies 60 to keep a distance between the vertical rails 30 and the wallboard 80. However, the vertical rail positioning device of the second embodiment has multiple transverse tracks 40A mounted on the wallboard and paralleling the longitudinal rail 10 and multiple wheel sets 60A mounted on the vertical rail 30. The vertical rail positioning devices of the first and second embodiment both keep a distance between the vertical rail 30 and the wallboard 80 and stably move vertically on the wallboard 80. The second embodiment is described with accompanying drawings as follows.

The longitudinal rail 10, sliding, bracket 20 and vertical rail 30 of the second embodiment are the same as those in the first embodiment.

Figure 9:
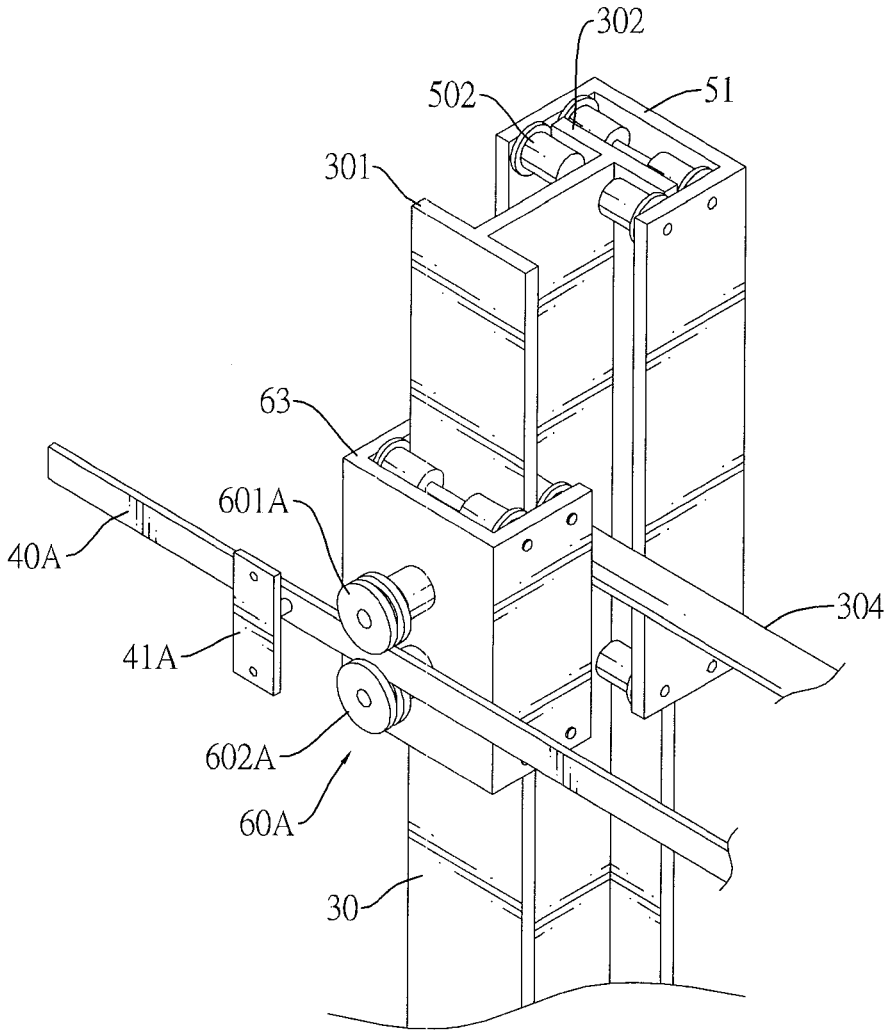
FIG. 9 is an enlarged perspective view of a vertical rail positioning device of the moving and suspending device in FIG. 5.
Figure 10:
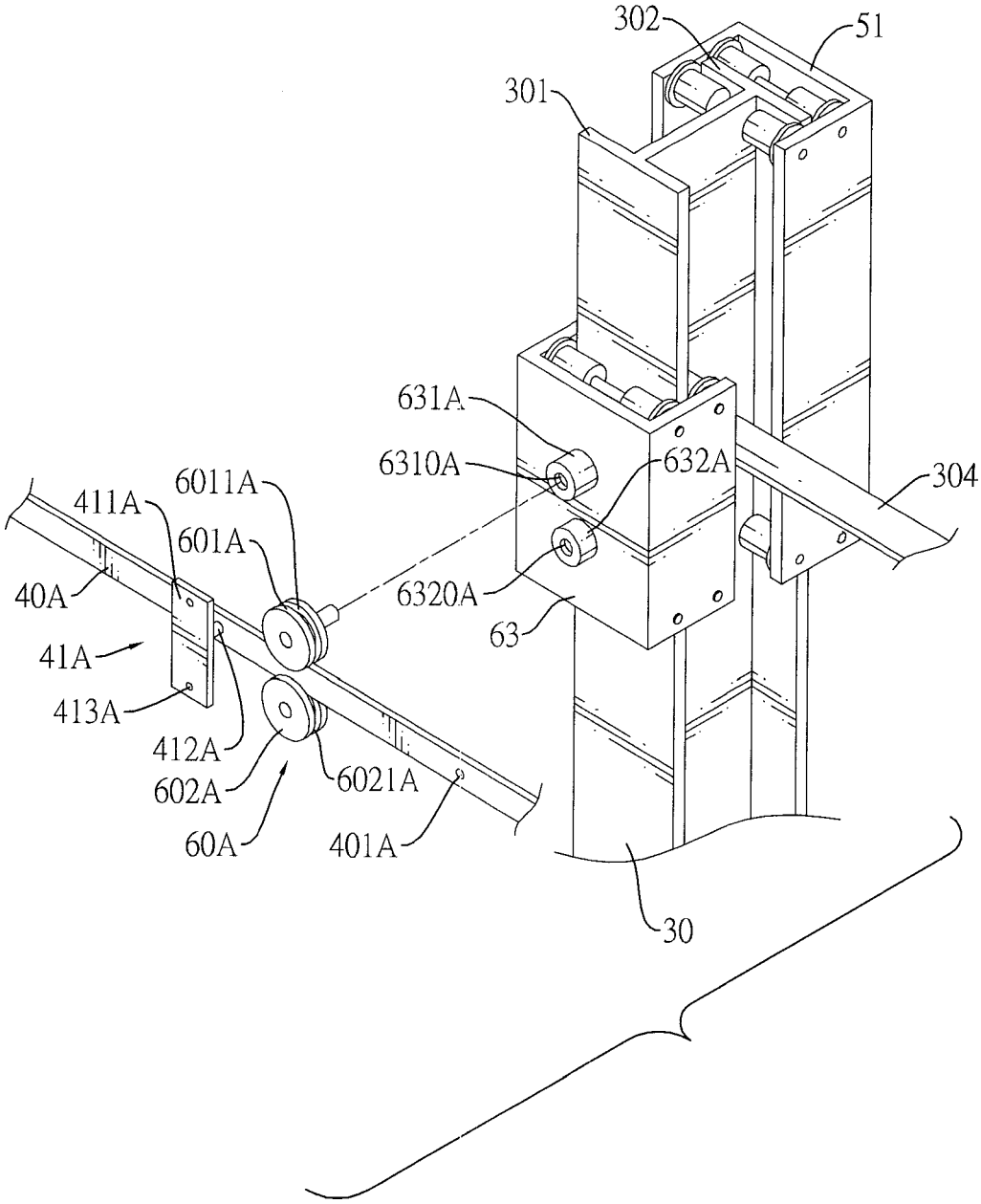
FIG. 10 is an enlarged and exploded perspective view of the vertical rail positioning device of the moving and suspending device in FIG. 9.

With reference to FIGS. 9 and 10, the vertical rail positioning device has at least one transverse track 40A, at least one support 41A and at least one wheel set 60A. The transverse track 40A is a transverse plate steel, T-shaped steel or C-shaped steel. For example, the transverse track 40A of FIGS. 9 and 10 is plate steel. The transverse track 40A has multiple mounting bores 401A defined through and arranged longitudinally on the transverse track 40A. Each mounting bore 401A is located at an intermediate section of the transverse track 40A. A support 41A has a mounting plate 411A and a supporting bar 412A. The mounting plate 411A has two fastening holes 413A defined therethrough so that fasteners extend respectively through the fastening holes 413A and fasten the mounting plate 411A on the wallboard 80. The supporting bar 412A is mounted on and extends from the mounting plate 411A and engages one of the mounting bores 401A of the transverse track 40A. The sliding member 63 is mounted slidably on the vertical rail 30 and has an upper mount 631A and a lower mount 632A. The upper mount 631A and lower mount 632A are mounted on the sliding member 63A and arranged in a vertical line. Each of the upper mount 631A and lower mount 632A has a mounting hole 6310A, 6320A defined therethrough. The wheel set 60A has an upper wheel 601A and a lower wheel 602A mounted rotatably and respectively in the mounting holes 6310A, 6320A of the upper mount 631A and lower mount 632A through axles. The upper wheel 601A and lower wheel 602A cooperate to form an engaging member. Each of the upper wheel 601A and lower wheel 602A has a groove 6011A, 6021A defined radially therein and engaging the transverse track 40A. A width of the groove 6011A, 6021A corresponds to a thickness of the transverse track 40A.

The movable basket 50 of the second embodiment is the same as that in the first embodiment.

With reference to FIGS. 2, 5, 9 and 10, an assembling method of the second embodiment of the moving and suspending device is as follows. A longitudinal rail 10 is mounted horizontally on an upper side of a wallboard 80 of an outer wall. A sliding bracket 20 is mounted on the longitudinal rail 10 and is movable by a motor 23. At least one vertical rail 30 is suspended downward from the sliding bracket 20. As shown in the aforementioned figures, two vertical rails 30 are suspended under the sliding bracket 20 and multiple crossbars 304 are mounted between the vertical rails 30 to connect the vertical rails 30 together. Multiple transverse shafts 40 are pulled tightly and mounted between two sides of the wallboard 80. Multiple transverse shafts 40A are mounted on the wallboard 80 by supports 41A. An upper wheel 601A and a lower wheel 602A of each wheel set 60A are mounted rotatably and respectively on the sliding member 63 at an intersection of each vertical rail 30 and each transverse track 40A with the upper and lower wheels 601A, 602A respectively engaging upper and lower edges of the transverse track 40A so that the vertical rail 30 keeps a distance from the wallboard 80 when moving transversely. With reference to FIG. 6, multiple slides 51 are mounted slidably on the outside plate 302 of the vertical rail 30. As shown in FIG. 6, two slides 51 are arranged vertically and disposed on the outside plate 302 of each of the two vertical rails 30. A movable basket 50 is mounted on the four slides 51 so as to move along the two vertical rails 30. A rolling device mounted on the sliding bracket 20 drives the movable basket 50 to move vertically by steel ropes. With reference to FIG. 7, the suspending and moving device may have a brushing device with a motor mounted on the movable basket 50. For example, a brush mechanism 53 is mounted on the movable basket 50 so as to brush and clean the wallboard 80. The brush mechanism 53 is conventional and therefore not described in detail.

Figure 5:
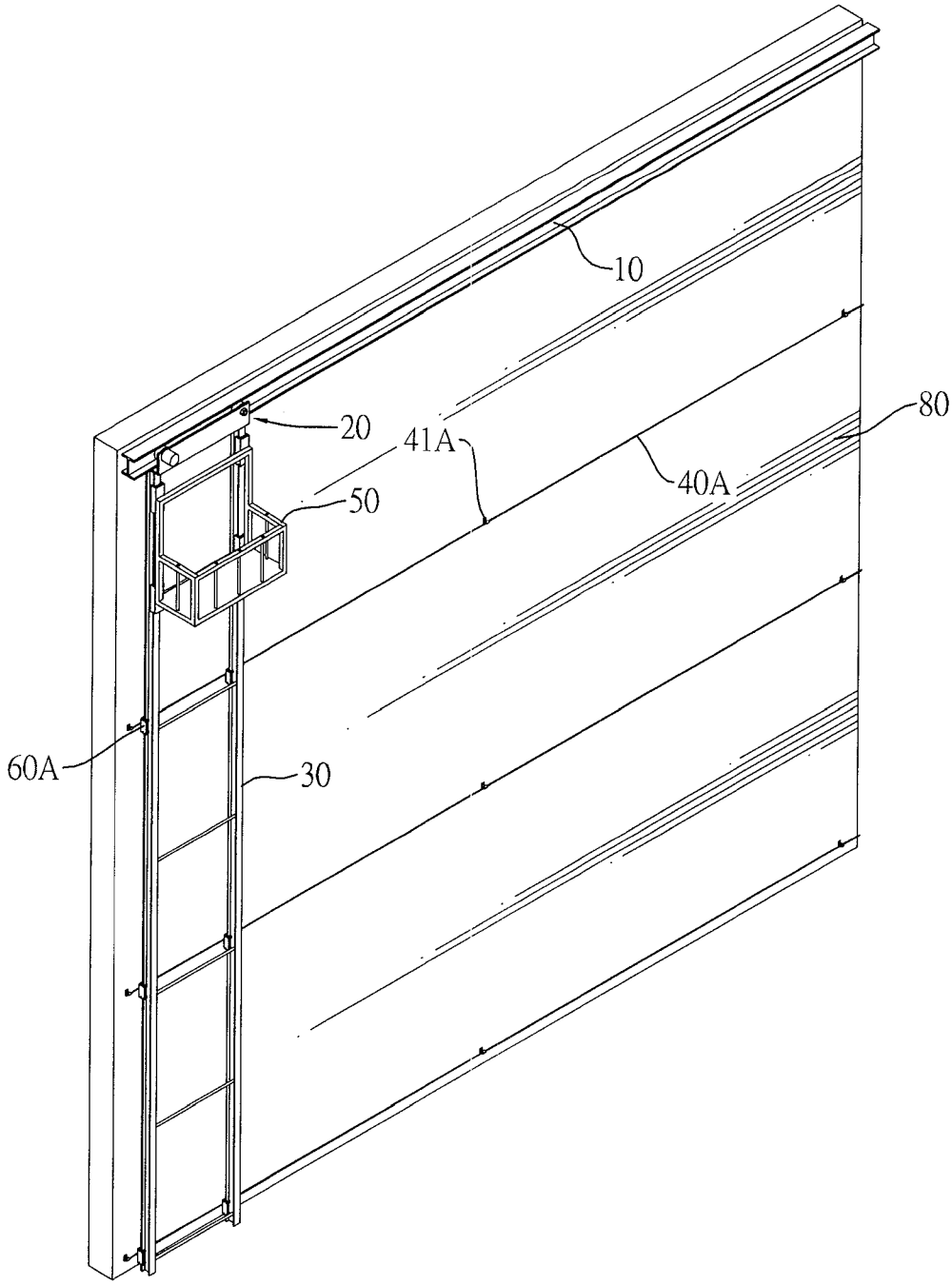
FIG. 5 is a perspective view of a second embodiment of a suspending and moving device in accordance with the present invention used on wallboards of an outer wall of a building.

With reference to FIGS. 5 and 9, a manner of using the second embodiment of the present invention is described as follows. The manner of using the second embodiment is similar to that of using the first embodiment.

When the suspending and moving device of the present invention is used to carry maintenance workers to maintain the wallboard 80, the motor 23 on the sliding bracket 20 is turned on to drive the sliding bracket 20, vertical rails 30 and movable basket 50 to move transversely on the longitudinal rail 10. Each wheel set 60A engages each transverse track 40A to keep the vertical rail 30 at a distance from the wallboard 80 during the movement of the sliding bracket 20 and the vertical rails 30 on the longitudinal rail 10. The rolling device may be turned on to drive the movable bracket 50 to move vertically and transport the maintenance workers to any place on the wallboard 80 as required. With reference to FIG. 7, when the suspending and moving device of the present invention is used to clean the wallboard 80, the motor 531 of the brush mechanism 53 on the movable basket 50 is electrically controlled to drive a brush to contact the wallboard 80. The movable basket 50 is moved vertically or transversely by the aforementioned moving method. The brush mechanism 53 is conventional and therefore not described in detail.

What is claimed is:

1. A suspending and moving device comprising:

a longitudinal rail mounted horizontally on an upper side of a wallboard of an outer wall and being a longitudinal configuration;

at least one sliding bracket corresponding to and mounted slidably on the longitudinal rail and having a motor to drive the sliding bracket to move longitudinally on the longitudinal rail;

at least one vertical rail suspended downward from a lower side of the sliding bracket;

a vertical rail positioning device having at least one transverse shaft mounted on the wallboard, paralleling the longitudinal rail and having two ends pulled tightly and mounted securely on two sides of the wallboard; and at least one stopping assembly, each stopping assembly mounted on an intersection of the vertical rail and the transverse shaft and mounted on a sliding member that is mounted slidably on the vertical rail;

at least one movable basket having at least one slide mounted on the movable basket and mounted slidably on the vertical rail to make the movable basket slide on the vertical rail;

whereby the movable basket is capable of moving vertically or transversely so that maintenance workers are carried by the movable basket to move or a brush mechanism is mounted on the movable basket to clean the wallboard;

wherein the transverse shaft has multiple supports mounted on the wallboard; and wherein the stopping assembly has a stopper located between the transverse shaft and the wallboard.

2. The suspending and moving device as claimed in claim 1, wherein each stopper is annular and has a thorn element formed on the stopper and having multiple radial thorns.

3. The suspending and moving device as claimed in claim 2, wherein each radial thorn has a distal end with a tip.

4. The suspending and moving device as claimed in claim 3, wherein an assistant wheel is mounted rotatably on the distal end of each radial thorn.

5. The suspending and moving device as claimed in claim 4, wherein the stopper of the stopping assembly is rotatable.

6. The suspending and moving device as claimed in claim 5, wherein the stopping assembly has a wheel mounted rotatably between the vertical rail and the transverse shaft.

7. The suspending and moving device as claimed in claim 6, wherein the stopper and the wheel are mounted rotatably respectively on an upper side and a lower side of the transverse shaft.

8. The suspending and moving device as claimed in claim 7, wherein the stopping assembly has the sliding member connected to the stopper and the wheel.

9. The suspending and moving device as claimed in claim 8, wherein the movable basket is a human carriage.

10. The suspending and moving device as claimed in claim 9, wherein the movable basket has a brush mechanism mounted thereon and being capable of brushing the wallboard.

11. A suspending and moving device comprising:

a longitudinal rail mounted horizontally on an upper side of a wallboard of an outer wall and being a longitudinal configuration;

at least one sliding bracket corresponding to and mounted slidably on the longitudinal rail and having a motor to drive the sliding bracket to move longitudinally on the longitudinal rail;

at least one vertical rail suspended downward from a lower side of the sliding bracket;

a vertical rail positioning device having at least one transverse track mounted on the wallboard and paralleling the longitudinal rail; and at least one engaging member mounted on an intersection between the vertical rail and the transverse shaft and mounted on a sliding member that is mounted slidably on the vertical rail;

at least one movable basket having at least one slide mounted on the movable basket and mounted slidably on the vertical rail to make the movable basket slide on the vertical rail;

whereby the movable basket is capable of moving vertically or transversely so that maintenance workers are carried by the movable basket to move or a brush mechanism is mounted on the movable basket to clean the wallboard;

wherein the engaging member has an upper wheel and a lower wheel mounted on the sliding member and engaging the transverse track;

wherein the movable basket is a human carriage; and wherein the movable basket has a brush mechanism mounted thereon and being capable of brushing the wallboard.

* * * * *